United States Patent [19]

Bonomelli

[11] Patent Number: 4,961,301

[45] Date of Patent: Oct. 9, 1990

[54] PROCESS AND APPARATUS FOR THE CONTINUOUS MANUFACTURE OF FILTER PAPER BAGS FOR INFUSIONS, PROVIDED WITH THREAD AND TAG

[76] Inventor: Federico Bonomelli, Via Mazzini, 18, 22042 Dolzago (CO), Italy

[21] Appl. No.: 387,345

[22] Filed: Jul. 28, 1989

[30] Foreign Application Priority Data

Apr. 13, 1989 [IT] Italy ..... 20133 A/89

[51] Int. Cl.[5] ..... B65B 29/04

[52] U.S. Cl. ..... 53/413; 53/134; 493/375

[58] Field of Search ..... 53/413, 417, 134, 202; 493/375, 961, 926, 226

[56] References Cited

U.S. PATENT DOCUMENTS

| | | | |
|---|---|---|---|
| 2,777,408 | 1/1957 | Beck | 53/134 X |
| 2,913,860 | 11/1959 | Irmscher | 53/134 X |
| 3,566,573 | 3/1971 | Irmscher | 53/413 X |
| 4,609,556 | 9/1986 | Goedert | 53/202 X |
| 4,853,071 | 8/1989 | Romagnoli | 53/134 X |

FOREIGN PATENT DOCUMENTS

| | | | |
|---|---|---|---|
| 1290580 | 3/1962 | France | 53/413 |

*Primary Examiner*—James F. Coan

*Attorney, Agent, or Firm*—Notaro & Michalos

[57] ABSTRACT

Process for the continuous manufacture of filter paper bags for infusions, each of them being provided with a thread and a tag applied thereto, wherein a portion of the tag surface is adhesive and is exploited to fasten the thread and tag to a filter paper strip employed for making the bag, and a machine for putting the process into effect.

4 Claims, 3 Drawing Sheets

FIG 3
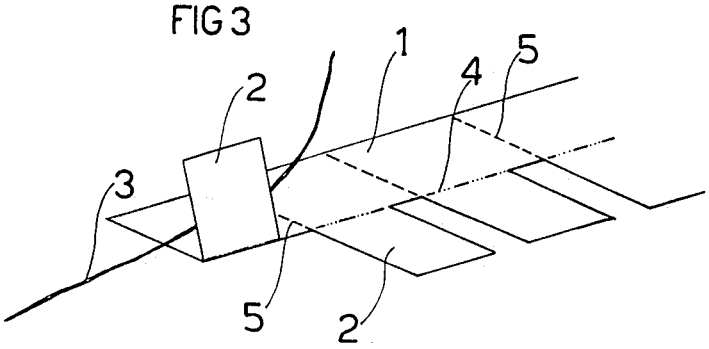
FIG 2
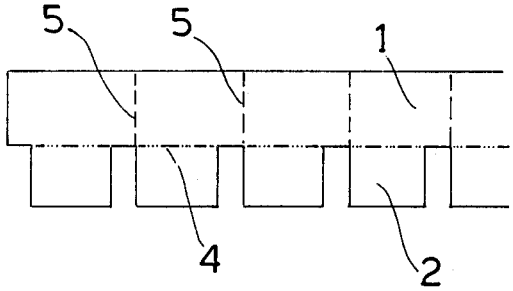
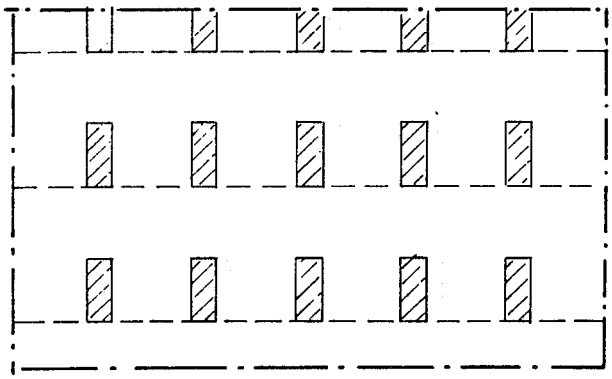
FIG 1

PROCESS AND APPARATUS FOR THE CONTINUOUS MANUFACTURE OF FILTER PAPER BAGS FOR INFUSIONS, PROVIDED WITH THREAD AND TAG

FIELD AND BACKFROUND OF THE INVENTION

The present invention provides a process for the continuous production of filter paper bags for infusions, each of said bags being provided with a thread to which a small tag is applied.

By the wording "process for the continuous production" is meant a process for manufacturing a plurality of filter paper bags not one at a time in batch, but simultaneously.

A typical example showing the application of the process according to the invention concerns the manufacture of bags for infusions such as tea or other herbs, these bags containing one dose of product, a thread being generally applied to them, to the other end of said thread there being applied a small tag with an indication of the product itself.

Various systems are known in the state of the art, each using a specific machine for manufacturing and filling these bags. All the known systems provide for the making of one single bag at a time; up to now, all the attempts aiming at cutting the production times have been intended for the increase in the operative speed, and, accordingly, in the productive capacity of the manufacturing machines.

It is easy to imagine which and how many difficulties are met in making apparatus capable of providing a high hourly output, though making only one bag at a time.

All the attempts to try and find a solution to this problem, numerous as they may have been, did not give any positive results: in fact, in order to obtain a sufficiently high output per hour (about 400–500 bags per minute), very bulky, complex, noisy and expensive machines should be used. According to a known method for producing filter bags one starts from a roll of filter paper from which are made a series of sheets, each intended to form a filter bag, that are folded about a blade which, as it moves forward, drives each sheet along a track where said sheet is folded also along its side edges, so as to obtain a bag that, after filling, is closed also at the remaining side and sealed by a staple whereby, at the same time, a thread is applied, to the opposite side of which there is stitched a small tag.

According to another known process, a filter paper strip is folded into in the longitudinal sense as it is unwinding from a roll, and is inserted between one pair of knurled wheels that seal the two paper layers together, so as to obtain a series of bags, joined to one another, each having an open side.

Immediately after the filling of each bag, the fourth side is sealed, after which the bags are separated by cutting.

According to this process a thread—to which the tag had already been connected, simultaneously with the making of the bag—is inserted between the two paper layers in correspondence of the still open side of the bag, just before sealing, so that the head of the thread is secured between the two paper layers.

According to another known process, the bags, prepared as hereinabove described, are sewn by means of a staple to a continuous thread, to which the tag is fixed at the same time.

This thread, on which a plurality of bags alternating with as many tags hang, is cut during a successive step.

According to a further known process, the tags, cut from a strip of paper coated at one side with a thermoplastic material, are folded about one thread and thermally sealed. A filter paper band moves forward in a direction orthogonal to that of the tag-carrying thread, said thread being pressed against the paper to which it adheres.

Then the paper band with the threads and relevant applied tags is longitudinally folded in order to make the bags, that are subsequently filled, sealed and cut.

As it can be seen, all the described known processes are directed to the making of just one bag at the time, and have therefore the following drawbacks.

Apart from the various proposed solutions, in fact, the increase in the machine productivity has always been hindered since, however sophisticated and perfected these machines may be, their working at high speeds gives always rise to considerable problems.

There is actually no known process for the continuous manufacture of filter paper bags with thread and tag.

Such a solution would obviously be extremely useful, as it would enable a considerable increase in productivity, by employing 'slow' machines.

SUMMARY OF THE INVENTION

To this end the present invention provides a process for manufacturing filter paper bags, each with its own thread and tag, said process enabling the continuous production, that is to say the simultaneous manufacture of more than one bag at each cycle.

The invention provides for applying to a filter paper band a series of tags, having an adhesive surface portion, and being secured to the very thread that moves forward along with the paper strip itself. The paper strip is cut in correspondence of the adhesion area of each tag, so as to obtain as many strips, each having a thread applied at the two opposite sides, by means of the sticky portion of one tag and of the sticky portion of the contiguous tag, respectively. The paper strip with its thread and tag is then folded and sealed to form the bag.

BRIEF DESCRIPTION OF THE DRAWINGS

The present invention will now be described in detail, with special reference to the attached drawings, in which:

FIGS. 1 to 4 show the manufacturing steps of the tags, and their application to the thread;

DESCRIPTION OF THE PREFERRED EMBODIMENT

Figure 4:
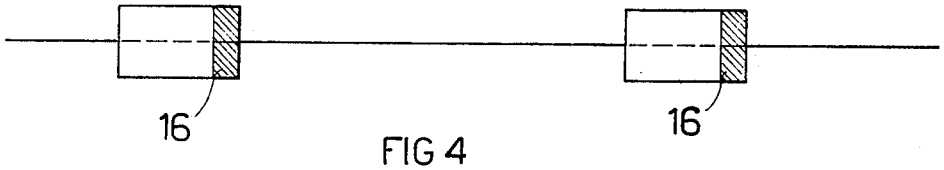

The novelty of the process according to the invention lies in the way in which the thread with the tags are preparaed and applied to the filter paper band: to this end, a sticky part of the tag surface is exploited. The tags are made according to the invention starting from a paper sheet coated, at one side, with thermosealable material such as for instance polypropylene, by punching the paper sheet as shown in FIG. 1, and cutting out the cross-hatched zones.

The sheet is then cut along the dotted lines of FIG. 1, to obtain a series of first strips 1 (see FIG. 2), each provided with perforations of teeth 2 set spaced apart from one another by an indention between each strip 1 formed by the punched out zones.

A cotton thread 3 (see FIG. 3), located on the side of the polypropylene-coated strip, advances parallel to each strip 1.

Teeth 2 are then folded, one at a time, in correspondence of the line dots and dashes 4 by means of a heated bar that makes the two polypropylene layers contemporarily adhere to each other, so as to hold the thread therebetween.

At the same time or after each perforation 2 has been folded about the thread, the strip 1 is cut in correspondence of the dotted lines 5, to the purpose of taking off the just made tag; the later can thus be pulled away by the thread, which advances at a higher speed than that of the strip of paper.

There are thus obtained a series of threads to which a plurality of conveniently spaced apart tags are attached, as shown in FIG. 4.

Part of the surface of each tag 13 shown at 16 in FIG. 4—is coated with polyproplyene, and the width of said surface is equal to the distance among teeth 2 on strip 1.

The first tag of each strip is sealed to a filter paper band of which the bags are meant to consist, by pressing onto the polypropylene-coated tag surface.

Figure 5:
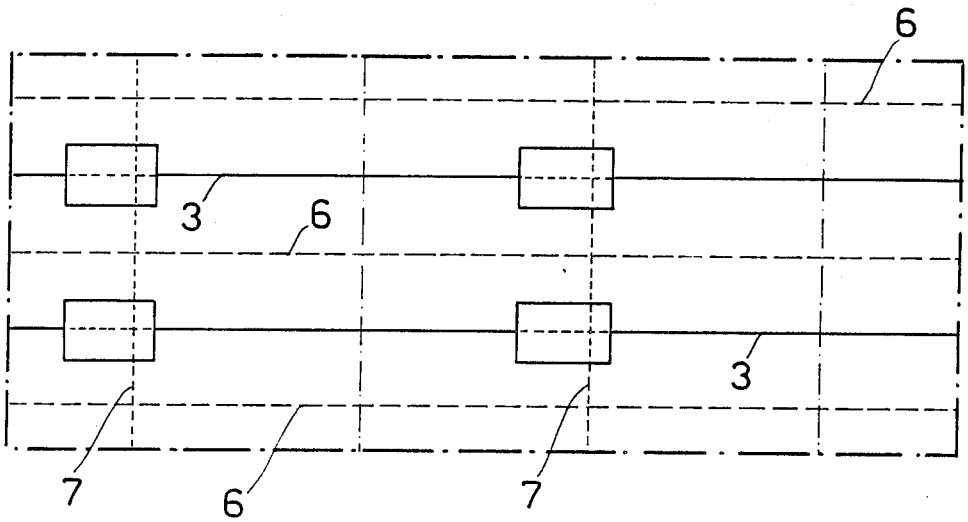
FIG. 5 shows the application step of the thread and tags to a filter paper strip.

FIG. 5 shows a filter paper band with the threads 3 and the relevant tags hanging on it. The paper band with the tags is cut along lines 6 and many independent strips are obtained, each one provided with a thread and the relevant series of tags.

The cut along lines 6 can be made even after the making and filling of the bag.

Figure 6:
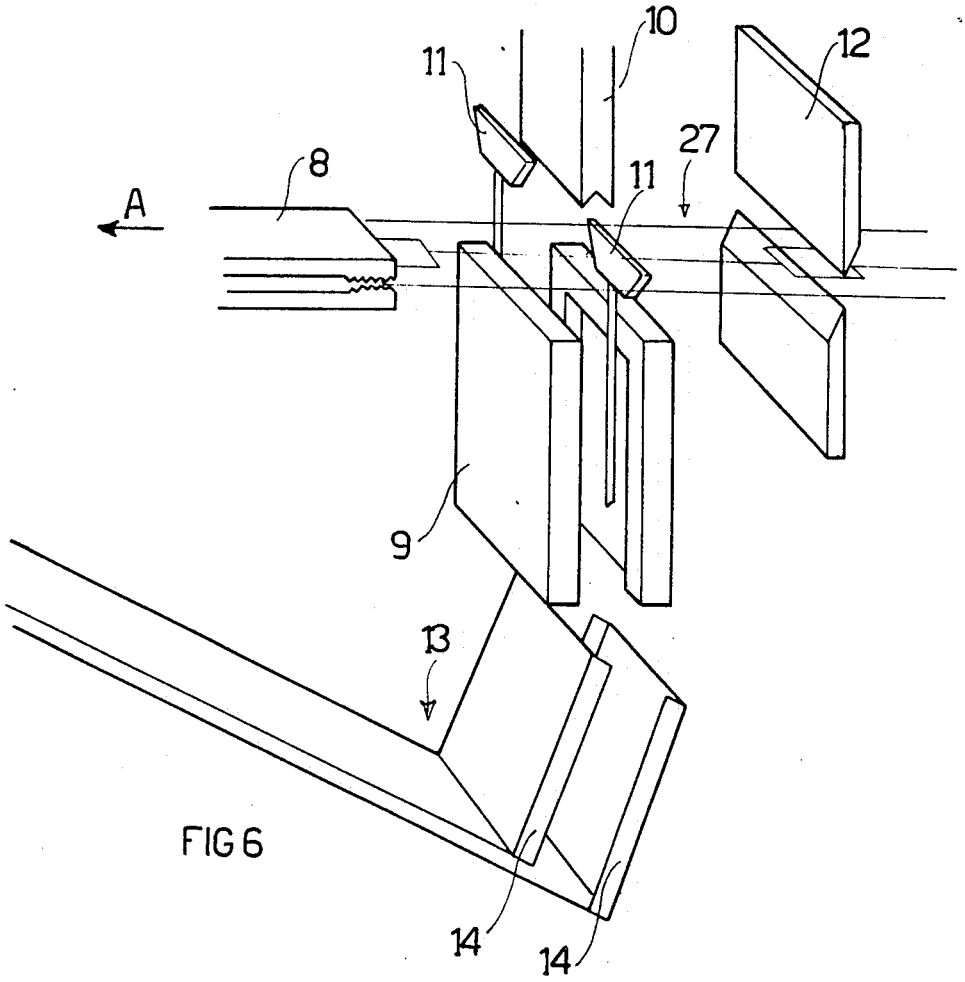
FIG. 6 is a diagram of an apparatus for the making and sealing of the bags.

Then each of these strips is cut along lines 7, for making the bag as schematically shown in FIG. 6.

Here the edge of a second strip, indicated by 27, is caught by pliers 8 that pull it forward each time (in the direction of arrow A) of the stretch corresponding to the distance between two consecutive tags.

After strip 27 has moved forward until the established point, a pair of reference elements 11 advances, from the bottom to the top, until it engages the strip and presses it against the lower part of funnel 10, which has a properly shaped lower edge.

At this point a blade or the like 12 cuts the strip along the adhesive zone of the subsequent tag.

Funnel 10 with the reference elements 11 and the cut filter paper band is let down, the sheet 27 being caught between elemenets 11, and the funnel 10 being connected with the central zone that will form the bottom of the bag.

At the same time, or shortly after, a container 13 consisting of two movable parts 14, is moved upwards.

The funnel 10 with sheet 27 are inserted between elements 14 of container 13 that act as reference elements, and sheet 27 is folded upwards about funnel 10. Then container 13 closed and elements 14, as they draw near to each other, make the filter paper band fold about the funnel even at the sides thereof, to form the real bag.

At this point the product is poured through funnel 10 and is emptied into the bag that is kept still by container 13, whilst the funnel moves upward until it comes out of the bag, and reference elements 11 are slipped off from the bottom and removed.

The further step is the sealing of the bag at the upper end and at both side edges by means of a pair of jaws 9.

Figure 7:
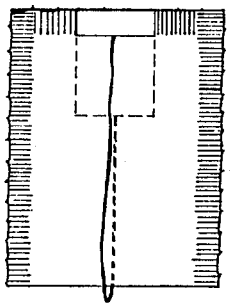
FIG. 7 is an elevational view of a bag with thread and tag, obtained in this way.

Jaws 9 can be placed under funnel 10, as shown in FIG. 6 (in which case container 13 will pass between said jaws) or, alternatively, they can be located in a subsequent station. A bag such as the one shown in FIG. 7 is thus obtained, with the thread folded up about the sides and sealed to the filter paper band at the upper edge, at both sides.

When sealing is over, jaws 9 open and container 13 lowers and subsequently opens to unload the bag.

What is claimed is:

1. A process for the making of filter paper bags with threads and tags for infusions, comprising:

punching out zones from a first paper sheet having one surface which is coated with thermosealable material;

cutting the first paper sheet into a series of first stripes each having a plurality of indentations defined by the zones with a plurality of teeth defined between the indentations;

folding the teeth of each first strip about a cotton thread which advances together with the first strip to form connected tags each having a portion of the coated surface exposed;

cutting each first strip to separate the tags, the separated tags being connected to each other by the thread of each first strip;

driving the thread and tags of each first strip to space the tags on the thread by lengths sufficient to engage the thread along opposite sides of bags to which the tags are to be connected;

applying the spaced tags of the first strips to a filter paper band along which the threads extend, using the exposed coated surface portions of the tags to obtain a continuous paper band to which there are applied, at regular intervals, a series of the spaced tags secured to the threads;

cutting said paper band along lines crossing the exposed coated surface portion of each tag so as to obtain a series of second strips each provided with a tag fixed at one side and a cotton thread connected to each tag;

pressing a lower edge of a filling funnel against an area of each second strip which is between two consecutive tags to fold and fill the second strip into an open bag around the funnel, having open side and top edges;

removing the funnel; and sealing the side and top edges of each bag closed.

2. A machine for making a filter paper bag with threads and tags for infusions, utilizing a process including the steps of punching out zones from a first paper sheet having one surface which is coated with thermosealable material, cutting the first paper sheet into a series of first strips each having a plurality of indentions defined by the zones with a plurality of teeth defined between the indentations, folding the teeth of each first strip about a cotton thread which advances together with the first strip to form connected tags each having a portion of the coated surface exposed, cutting each first strip to separate the tags, the separated tags being connected to each other by the thread of each first strips, driving the thread and tags of each first strip to space the tags on the thread by lengths sufficient to engage the thread along opposite sides of bags to which the tags are to be connected, applying the spaced tags of the first strip to filter paper band along which the threads extend, using the exposed coated surface portions of the tags to obtain a continuous paper band to which there are applied, at regular intervals, a series of the spaced tags secured to the threads, cutting said paper band along lines crossing the exposed coated surface portion of each tag so as to obtain a series of second strips each provided with a tag fixed at one side and a cotton thread connected to each tag, pressing a lower edge of a filling funnel against an area of each second strip which is between two consecutive tags to fold and fill the second strip into an open bag around the funnel, having open side and top edges, removing the funnel, and sealing the side and top edges of each bag closed, the machine comprising:

means for catching and end of each second strip with the applied thread and tags;

means for pressing said second strip against the lower edge of the funnel, at the area between two consecutive tags;

means for cutting said second strip;

means for folding said second strip about the funnel and taking hold of the second strip at the side edges thereof;

means for removing the funnel after a product has been introduced in the open bag, while the open bag is held by its side edges; and means for sealing the side and top edges of each bag closed.

3. A machine according to claim 2, including means for filling the bags before their side edges are sealed.

4. A filter bag with threads and tags for infusions, made according to the process comprising:

punching out zones from a first paper sheet having one surface which is coated with thermosealable material;

cutting the first paper sheet into a series of first strips each having a plurality of indentations defined by the zones with a plurality of teeth defined between the indentations;

folding the teeth of each first strip about a cotton thread which advances together with the first strip to form connected tags each having a portion of the coated surface exposed;

cutting each first strip to separate the tags, the separaged tags being connected to each other by the thread of each first strip;

driving the thread and tags of each first strip to space the tags on the thread by lengths sufficient to engage the tread along opposite sides of bags to which the tags are to be connected;

applying the spaced tags of the first strips to a filter paper band along which the threads extend, using the exposed coated surface portions of the tags to obtain a continuous paper band to which there are applied, at regular intervals, a series of the spaced tags secured to the threads;

cutting said paper band along lines crossing the exposed coated surface portion of each tag so as to obtain a series of second strips each provided with a tag fixed at one side and a cotton thread connected to each tag;

pressing a lower edge of a filling funnel against an area of each second strip which is between two consecutive tags to fold and fill the second strip into an open bag around the funnel, having open side and top edges;

removing the funnel; and sealing the side and top edges of each bag closed.

* * * * *